US007176610B2

(12) United States Patent
Katsap

(10) Patent No.: US 7,176,610 B2
(45) Date of Patent: Feb. 13, 2007

(54) HIGH BRIGHTNESS THERMIONIC CATHODE

(75) Inventor: Victor Katsap, Glenham, NY (US)

(73) Assignee: Toshiba Machine America, Inc., Elk Grove Village, IL (US)

( * ) Notice: Subject to any disclaimer, the term of this patent is extended or adjusted under 35 U.S.C. 154(b) by 410 days.

(21) Appl. No.: 10/774,693

(22) Filed: Feb. 10, 2004

(65) Prior Publication Data

US 2005/0174030 A1 Aug. 11, 2005

(51) Int. Cl.
*H01J 19/06* (2006.01)

(52) U.S. Cl. ..... 313/311; 313/309; 313/336; 313/346; 445/51

(58) Field of Classification Search ..... 313/346, 313/310, 449, 453, 309, 336; 445/50, 51
See application file for complete search history.

(56) References Cited

U.S. PATENT DOCUMENTS 4,528,474 A 7/1985 Kim
5,356,662 A * 10/1994 Early et al. ..... 427/140
2002/0020822 A1 2/2002 Okunuki

FOREIGN PATENT DOCUMENTS

WO WO 01/15192 3/2001

OTHER PUBLICATIONS

European Search Report dated Jun. 6, 2005.
XP-002330714, Davis P.R. et al. "The effect of oxygen pressure of volatility and morphology of LaB6 single crystal cathodes" Journal of Vaccum Science & Technology B (Microelectronics Processing and Phenomena) Jan.-Feb. 1986.

* cited by examiner

*Primary Examiner*—Joseph Williams
(74) *Attorney, Agent, or Firm*—Whitham, Curtis, Christofferson & Cook, PC

(57) ABSTRACT

An improved thermionic cathode is provided. The cathode has a carbon-coated cone surface and reduced cone angle (e.g. typically 60 degrees or less) that delivers an electron beam with high angular intensity and brightness and exhibits increased longevity.

25 Claims, 8 Drawing Sheets

90° cone angle
100 μm truncation

HIGH BRIGHTNESS THERMIONIC CATHODE

BACKGROUND OF THE INVENTION

The invention generally relates to an improved thermionic cathode design for use in electron beam lithography tools, scanning electron microscopes, etc. In particular, the invention provides a cathode with a carbon-coated cone surface that delivers an electron beam with high angular intensity and brightness and exhibits increased longevity.

Background of the Invention

Single crystal LaB6, or Lanthanum Hexaboride, cathodes are used as the electron source in various electron-beam tools [e.g. lithographic tools, scanning electron microscopes (SEMs), transmission electron microscopes (TEMs), etc.]. A typical LaB6 cathode emitter is tapered, or cone-shaped, with a specified size, cone angle, and tip, or truncation, as shown in the three-dimensional depiction in FIG. 1A. The tip (truncation) may be flat or spherical (as shown in the two-dimensional representations of FIGS. 1B and 1C, respectively), with a diameter ranging from 5 to 100 μm, and a cone angle ranging from 60 to 110 degrees, depending on the application. The tip typically represents a (100) crystalline plane.

LaB6 cathodes, however, have two built-in disadvantages. The first is that, as the cathode operates, evaporation causes the tip size of the cathode to continuously diminish, limiting the cathode's useful life time. At typical operating temperatures (1650 to 1900° K), LaB6 crystalline material evaporates at the rate of several microns per 100 hours. Eventually, the cathode tip comes to a point and the cathode's useful lifetime is at an end. This phenomena is illustrated in FIG. 2A–C, which show a schematic of a cathode emitter with a flat tip before use (A), at an intermediate stage of its lifetime (B) with diminished tip diameter, and at the end of its useful lifetime (C) when the tip is essentially reduced to a point. FIG. 2A–C illustrate that the surface of the tip 11 diminishes as evaporation of material from the tip surface 11 and the cone-shaped area of the emitter 14 occurs with time.

This phenomenon can be explained as follows: LaB6 has cubic crystalline structure. Cathodes are made in such a way that the flat tip represents a (111) or (100) crystalline plane. Since 1990, all commercial LaB6 cathodes are made of the (100) type, meaning that the tip represents a (100) crystalline plane (Gesley, M and F. Hohn, *J. Appl. Phys.* 64 (7), October 1988, pp. 3380–3392.). At operating temperatures, LaB6 evaporates with a rate that depends on temperature and vacuum pressure, usually about 4 microns/100 hours. This leads to a shape change, as illustrated in FIG. 2. After approximately 500 hours of operation, a layer approximately 20 micron thick is lost (evaporated). Because the main crystal body size (15 in FIG. 2) is about 200 to 800 microns, this amount of evaporation does not significantly change the shape of the main crystal body. However, for the tip, which has a much smaller diameter (e.g. 50 microns) a 20 micron loss per side is a major change, resulting in the (100) plane no longer being exposed, and adversely affecting cathode optics and emission The cone angle of an LaB6 cathode affects cathode lifetime (Davis, P. R. et. al., *J. Vac. Sci. Technol.*, B4 (1), (1986), pp. 112–116.): the sharper the cone, the shorter the lifetime. Reduction of the cathode tip radius ΔRf depends on cone angle 2 α and evaporation rate ΔRv as $$\Delta Rf=\Delta Rv*(1/\cos\alpha-\tan\alpha)$$

For high quality LaB6 crystals in a vacuum of $1\times10^{-7}$ Torr, ΔRv is 0.04 μm/hour. Consequently, if ΔF is a given acceptable loss of the tip radius, the cathode evaporation-limited lifetime T may be estimated as $$T=\Delta F/\Delta Rv*(1/\cos\alpha-\tan\alpha)\text{hrs}$$

Thus, in order to obtain longer cathode lifetimes, the LaB6 cone angle should be increased. Unfortunately, LaB6 cathode brightness and angular intensity decrease with increasing cone angle (FIG. 3). Consequently, in order to obtain an electron beam with high brightness and high angular intensity, one must compromise on the length of the LaB6 cathode lifetime, and vice versa.

The second major disadvantage of LaB6 cathodes is that, under operating conditions, the electron beam of the cathode is formed by electrons emitted from both the tip and cone surface, as shown in FIG. 4. FIG. 4 shows emitter tip 11 and cone surface 13. Electrons emitted from the cone surface 13 constitute up to 65% of the total emission current, but cannot be used in well-focused beams (Gesley and Hohn, 1988; Sewell, P. and A. Delage, in *Electron Optical Systems*, SEM Inc., Chicago, 1984, pp. 163–170). These electrons must be cut off by an aperture stop, which complicates electron beam column design and heat dissipation management, and may lead to high voltage breakdowns. Cone-emitted electrons exacerbate both global and stochastic space-charge effects (Orloff, J. editor, *Handbook of Charged Particle Optics*, CRC, New York, 1997, pp. 275–318), thus limiting beam focusing quality, electron beam tool minimum achievable beam spot size, and maximum achievable beam angular intensity and brightness.

The prior art has thus far failed to provide a cathode design that results in suppression or elimination of material evaporation and electron emission from the cone surface of LaB6 cathodes.

SUMMARY OF THE INVENTION

The present invention provides a means to enhance electron source angular intensity and brightness (e.g. in a LaB6 cathode) by greatly suppressing or eliminating cathode cone emission and evaporation. According to the invention, an innovative cathode, a "K-cathode", which includes a carbon coating applied to the cone surface, is shaped to provide maximum angular intensity and brightness (and thus improved electron beam focusing quality) together with extended cathode lifetime.

It is an object of the invention to provide an improvement in a thermionic cathode having a crystalline emitter with a tip and a cone so as to extend cathode life and at the same time reduce cone-emitted electrons. The invention thus provides a thermionic cathode comprising a crystalline emitter having a tip and a cone where a carbon coating is applied to the outer surface of the cone. Preferably, the crystalline emitter is single crystal Lanthanum Hexaboride (LaB6), and the cone angle is in the range of 20 to 60 degrees. The carbon coating of the cathode may be, for example, diamond-like carbon (DLC) or pyrolytic carbon, with a thickness of from about 8 to about 10 μm. This thickness may be at least about twice the thickness of a microroughness of the cone surface.

The present invention further provides an electron emission apparatus. The apparatus comprises a thermionic cathode which comprises a crystalline emitter having a tip and a cone, and an outer cone surface having an applied carbon coating; an emitter heater; and a support for holding the components of the apparatus in positions suitable for operation of the apparatus.

The invention further provides a method of suppressing electron emission from the outer surface of a cone of a crystalline emitter in a thermionic cathode. The method includes the step of applying a carbon coating to the outer surface of the cone. The carbon coating causes suppression of electron emission from the outer surface. The crystalline emitter may be single crystal Lanthanum Hexaboride (LaB6), and the cone may have a cone angle in the range of 20 to 60 degrees. The carbon coating may be, for example, pyrolytic carbon, or diamond-like carbon (DLC).

The invention further provides a method of manufacturing a crystalline emitter for use in a thermionic cathode. The method comprises the step of applying a carbon coating to an outer surface of a cone of the crystalline emitter. The carbon coating contains no pinholes, and the crystalline emitter may be a single crystal Lanthanum Hexaboride (LaB6). The cone has a cone angle in the range of about 20 to about 60 degrees. The carbon coating may be, for example, pyrolytic carbon or diamond-like carbon (DLC). In one embodiment, the cone has a surface micro-roughness and the carbon coating has a thickness of at least twice the micro-roughness. In yet another embodiment, the thickness of the carbon coating is from 8 to 10 μm.

DETAILED DESCRIPTION OF THE PREFERRED EMBODIMENTS OF THE INVENTION

The present invention provides an improved design for thermionic electron sources such as LaB6 cathodes. The cathodes of the present invention (K-cathodes) exhibit superior brightness and longevity compared to conventional cathodes due to a layer or coating of carbon that is deposited on the surface of the conical portion of the cathode crystal. At typical cathode operating temperatures (1650 to 1900° K.), the evaporation rate of the carbon coating is very low, with a vapor pressure of approximately $10^{-10}$ Torr. Hence, evaporation is extremely slow, or even negligible, and the dimensions of the coating (and consequently of the underlying surface) do not change appreciably during the lifetime of the cathode (about 3000 hrs). In addition, carbon electron emission at these operating temperatures is also very low, ~1000 times lower than that of LaB6, and is also, for all practical purposes, negligible. Therefore, the carbon-coated cathode of the present invention exhibits neither significant electron emission nor evaporation (material loss) from its cone surface, resulting in enhancement of angular intensity and brightness. The inherent cathode disadvantages discussed above are thus eliminated.

Further, the innovative cathode of the present invention may be "shaped" to maximize angular intensity and brightness and/or long lifetime of the cathode, e.g. the cone angle may be decreased compared to a conventional cathode in order to increase angular intensity and brightness without sacrificing longevity of the cathode crystal.

Figure 5A:
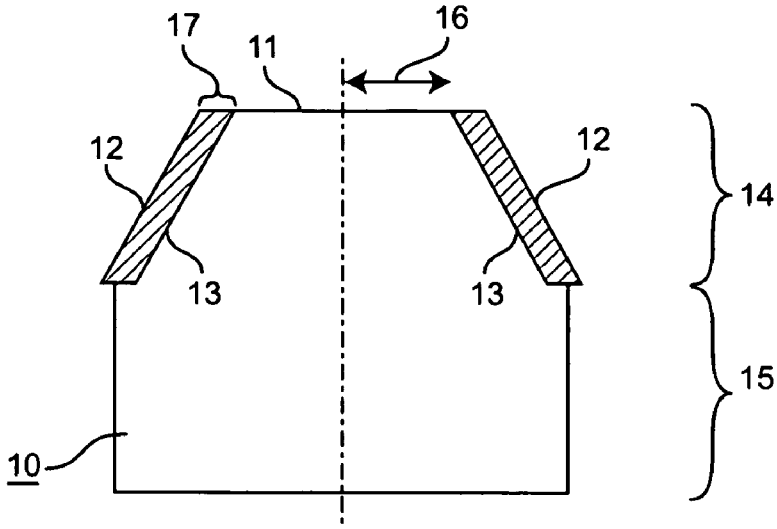
FIGS. 5A, B and C. A, Schematic representation of the cathode of the present invention showing a cross sectional view (A), a perspective view (B) and a top view (C)
Figure 5B:
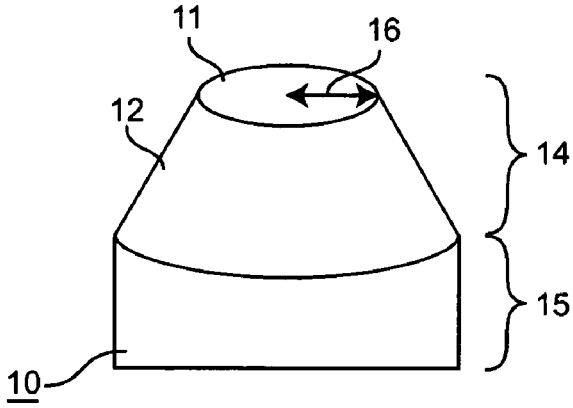
Figure 5C:
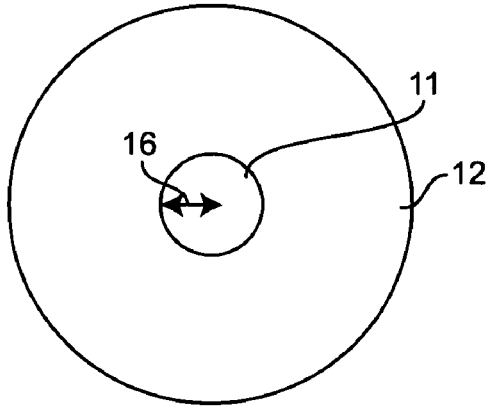

Schematic representations of a cathode of the present invention are given in FIG. 5A–C. FIG. 5A shows a cross sectional view of cathode body 10 having a lower cylindrical or rectangular portion 15 and an upper tapered portion 14, with a flat truncated tip 11 and cone sides 13 covered by a carbon coating 12. FIGS. 5B and 6C are a perspective view and a top view, respectively, of a cathode showing radius 16 of tip 11.

In a preferred embodiment, the electron emitter utilized in the practice of the present invention is an LaB6 crystal, the resultant cathode being a "K-LaB6" cathode. However, application of the technology should not be limited to use with LaB6 cathodes. For example, the same technology can be used for CeB6 (cerium hexaboride) crystalline emitter.

In preferred embodiments of the invention, the carbon coating is in the form of, for example, DLC (diamond-like carbon). However, those of skill in the art will recognize that other forms of carbon may also be used in the practice of the present invention, examples of which include but are not limited to pyrolytic carbon. The choice of carbon coating may depend upon several factors which are well known to those of skill in the art, including but not limited to cost of cathode production, facilities available for carrying out deposition, available materials, etc. For example, two major techniques of carbon deposition are commonly used, CVD-deposition (which tends to be costly) and pyrolytic carbon deposition, which is more economical. Any method of carbon deposition may be utilized in the practice of the present invention, so long as the resulting cathode has a carbon coating on the conical surface of the cathode crystal.

With reference to FIG. 5, the carbon coating 12 is applied to the surface 13 of the tapered, conical portion 14 of the crystal body 10. In general, the tip of the crystal body 11 is kept free of carbon and/or the carbon deposited on the tip is later removed so that emission from the tip 11 is not reduced. The sides of the crystal 15 in general should not be carbon coated, as this might lead to increased surface emissivity and greater heat loss by infra-red (IR) radiation, requiring greater heating power. The sides of the crystal will evaporate over time, but in general such evaporation does not affect cathode optical performance or lifetime.

Those of skill in the art will recognize that several methods for accurately applying a carbon coating to such a surface exist, including but not limited to techniques found in Bokros, J. C. "Deposition, structure, and properties of pyrolytic carbon", in: *Chemistry and Physics of Carbon*, P. L. Walker Jr. (ed), Marcel Dekker Inc., New York, 1969. Typically, the carbon coating will be of a thickness in the range of from about 2 μm to about 20 μm, and preferably from about 5 μm to about 10 μm, depending on, for example, the initial LaB6 surface micro-roughness and the deposition technique used. The carbon coating must be continuous, without pinholes. In general, the thickness should be at least 2 times greater than the LaB6 surface micro-roughness. The thickness will further depend on the carbon deposition technique that is utilized: each technique is able to provide a continuous film starting from some minimal thickness. Care must also be taken not to deposit a film that is too thick, as too thick a film may become stressed and develop cracks. Each deposition technique offers its own minimum/maximum thickness for formation of a pinhole-free film (see Mattox, D. *Vacuum Technology and Coating Magazine*, January 2004, pp 6–12). Further, the carbon coating should be of a relatively uniform thickness, with deviations of no more than about 10% or less of the total thickness across the surface to which it is applied. The carbon is exposed to the cathode electric field, and a non-uniform coating may distort this field and harm cathode electron-optical quality.

In some embodiments of the invention, the cathode of the present invention is "shaped". By "shaped" we mean that the dimensions of the crystal (e.g. the cone angle, the truncation diameter, shape and size of crystal body, etc., may be tailored or modified to achieve a desired effect. These parameters may be modified or tailored so as to attain, for example, a desired angular intensity and brightness, and/or lifetime, of the emitter. In particular, it is the cone angle which may be modified. Those of skill in the art will recognize that, depending on circumstances surrounding the use of the cathode, it may be desirable to manipulate one or the other of the two competing attributes (angular intensity and brightness vs lifetime). For example, there may be instances in which maximum angular intensity and brightness are desirable or required, even at the expense of decreased lifetime of the cathode. On the other hand, there may be other circumstances for which it is desirable to maximize the lifetime of the cathode, even though maximum angular intensity and brightness are not achieved. Those of skill in the art will recognize that, given the guidance provided herein, it is possible to adjust the parameters of the crystal in order to achieve a wide range of desired cathode performance, due to the stabilizing influence of the carbon coating. In particular, it is possible to achieve much higher levels of angular intensity and brightness and still maintain an extended cathode lifetime.

The crystal body may be of any suitable, convenient and useful shape. In preferred embodiments of the invention, the crystal body is cylindrical with a circular cross-section and a diameter in the range of about 200 μm to about 800 μm. Alternatively, the shape may be a rectangular solid with a rectangular cross section, in which a diagonal of the rectangle is in the range of about 200 μm to about 1600 μm. The choice of crystal body shape and size will generally depend on the particular cathode application (including but not limited to SEM, TEM, lithography tool, probe, free electron laser, electron and ion guns, etc.) and the type of heater employed. For example, a Vogel heater requires a rectangular crystal body shape (Vogel, S. F. *Rev. Sci. Instr.,* 41,585, 1970) and a coaxial heater requires a cylindrical crystal body shape (Hohn, F. et al., *J. Appl. Phys.,* 53(3), March 1982).

Figure 1A:
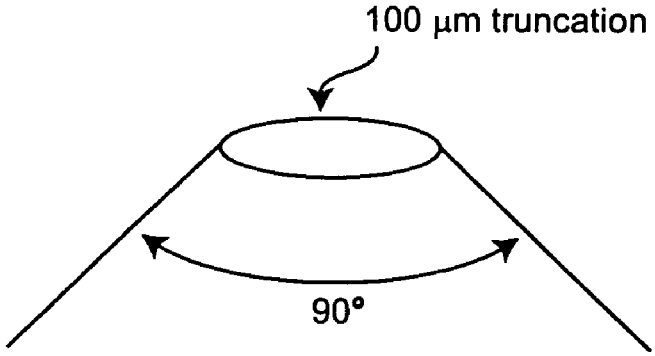
FIG. 1. Schematic representation of the tip of a LaB6 cathode showing the taper of the cone and the truncation.
Figure 1B:
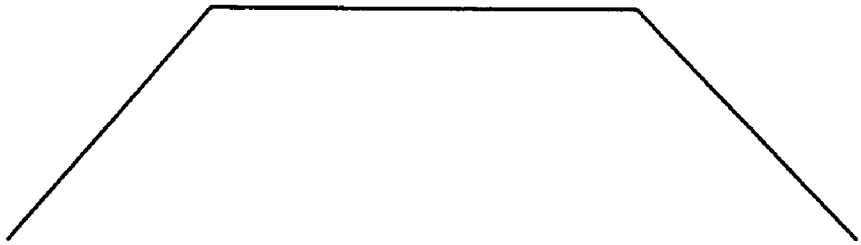
Figure 1C:
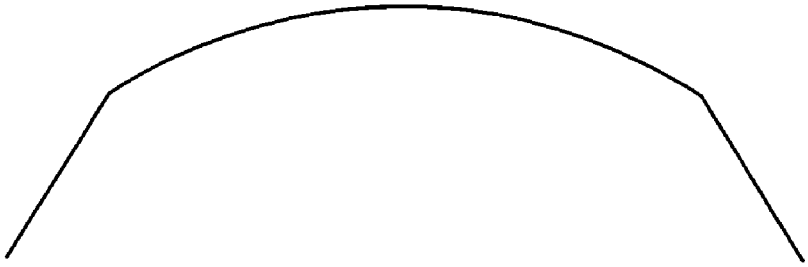
Figure 2A:
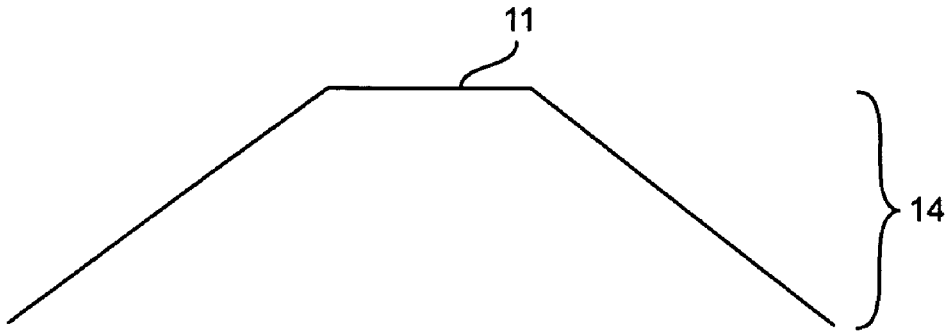
FIG. 2. Illustration of evaporation of LaB6 crystalline material diminishing the tip size of the cathode.
Figure 2B:
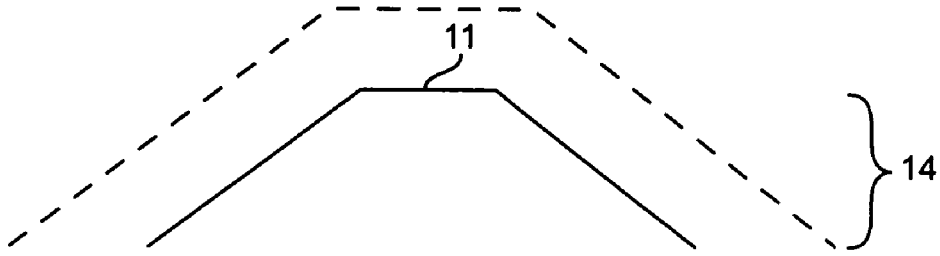
Figure 2C:
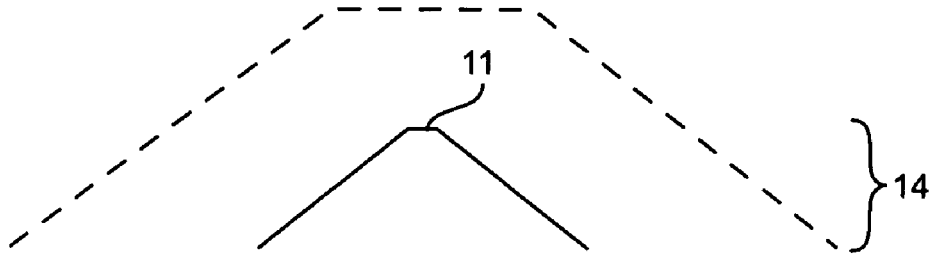
Figure 3:
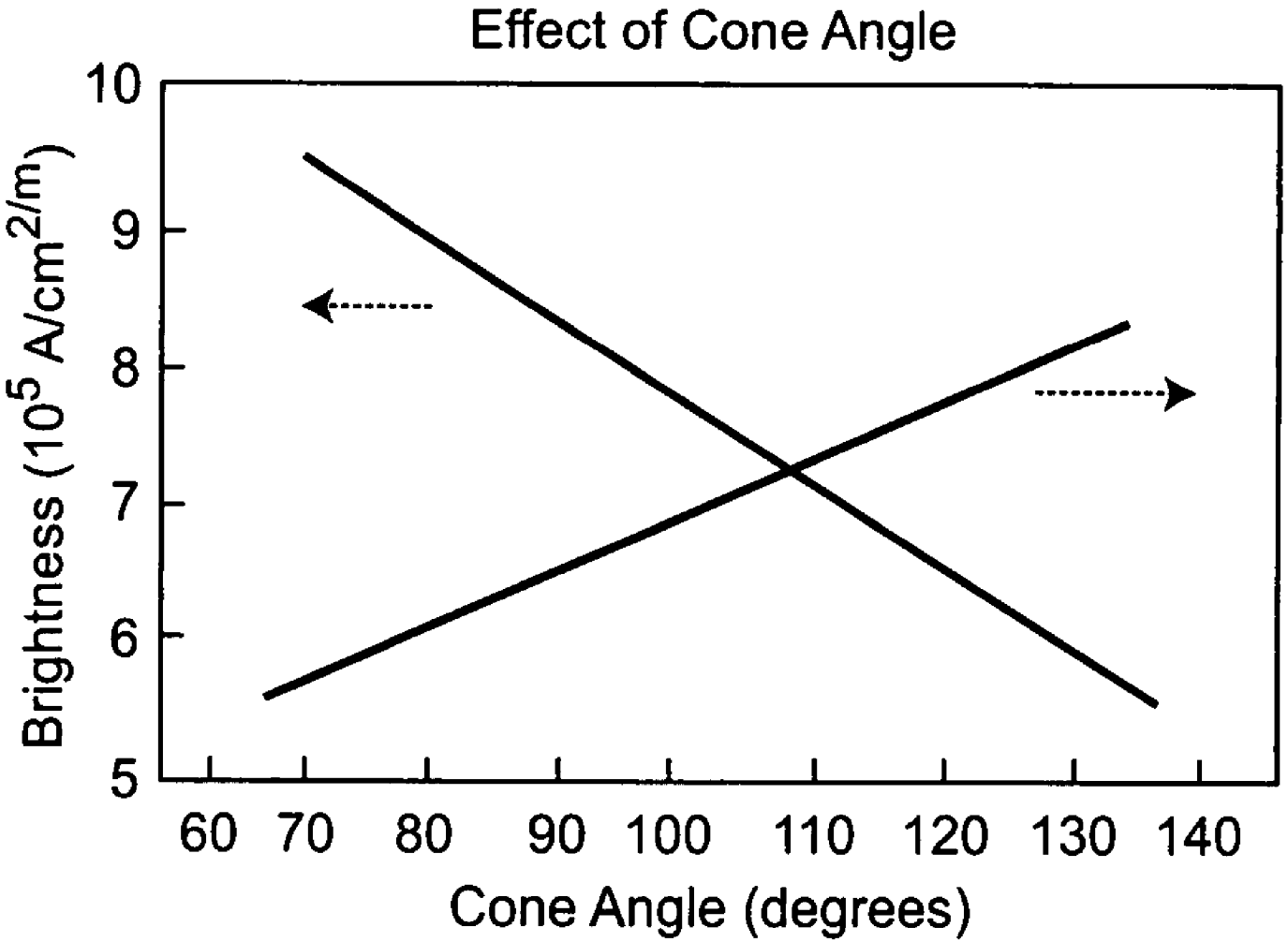
FIG. 3. Illustration of the decrease in LaB6 cathode brightness and angular intensity with increasing cone angle.
Figure 4:
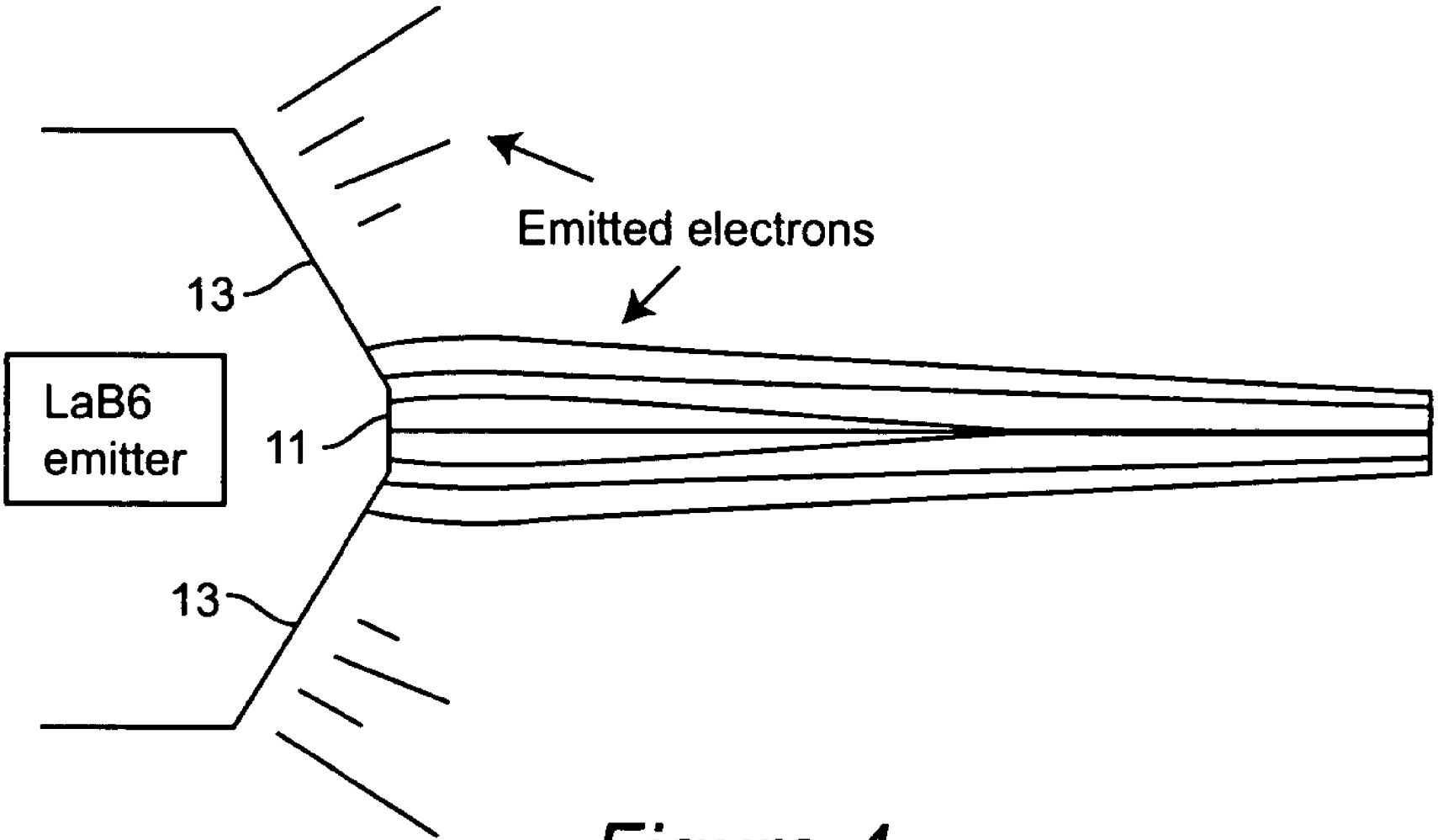
FIG. 4. Illustration of formation of electron beam of the cathode by electrons emitted from both the tip and cone surface.

Likewise, the emitter tip (truncation) of the cathode of the present invention may be of any suitable shape. In preferred embodiments, the emitter tip may be flat (as in FIG. 1B) or curved (e.g. spherical or dome-shaped as in FIG. 1B). The diameter of the tip is generally in the range of from about 5 μm to about 100 μm, and preferably in the range of from about 5 μm to about 70 μm. The shape and size of the tip of the cathode chiefly impact cathode maximum brightness and maximum emission current available. The selection of a particular size will be based largely on the particular application of the cathode. For example, for SEM, high brightness but small emission current is needed, so a tip size of about 5 μm may be optimal. In lithography tools, medium brightness and high emission current are required, so a tip of 50 μm size or greater may be optimal.

In the K-cathode of the present invention, cathode lifetime is limited by material loss (evaporation) from the tip only. Hence, the K-cathodes of the present invention may be designed with sharper cone angles to achieve greater angular intensity and brightness than with conventional cathodes, without compromising cathode lifetime. In general, the cone angle in the cathodes of the present invention should be no greater than about 90 degrees, and preferably no greater than about 60 degrees. In preferred embodiments, the cone angle is in the range of from about 20 to about 60 degrees. In general, brightness increases by about 1.0% to 3.5% per cone angle decrease of 1 degree. For example, a decrease of about 10 degrees in the cone angle will result in an increase in angular intensity and brightness of about 10–35%. Those of skill in the art will recognize that the precise increase also depends on factors such as the cathode operating temperature, the electric field applied, the surrounding electrode design, etc.

The invention further provides a method of manufacturing a cathode emitter by applying a carbon coating on the cone surface of the crystal, e.g. of an LaB6 crystal. As described above, the application of the carbon coating to the cone surface serves to attenuate electron emission from the cone surface and thus enhance cathode lifetime for a given angular intensity and brightness. As a result, the quality of electron beam focusing is improved.

Figure 6:
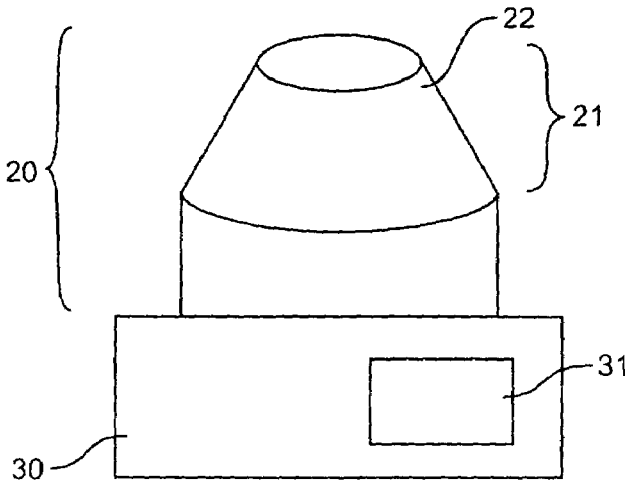
FIG. 6. Schematic representation of apparatus.

The present invention also provides an electron source (cathode) apparatus with exceptionally high angular intensity and brightness. A schematic representation of one such type of apparatus is shown in FIG. 6. The apparatus comprises a crystalline electron emitter 20, a portion of which (21) is cone-shaped and having a carbon coating 22 which is applied to the cone-shaped portion of the electron emitter; an emitter heater 31, and a support 30. Those of skill in the art will recognize that the support 30 (represented schematically in FIG. 6) functions to hold the components of the apparatus in positions suitable for operation of the apparatus, and may include such elements as a ferrule (e.g. a carbon ferrule) directly connected to the crystalline emitter; a base and/or sub-base (e.g. of ceramic) to which the various elements are connected; various mounting strips, clips, etc. for holding the support elements together. Those of skill in the art will recognize that the emitter heater of the apparatus (represented schematically herein as 31 of FIG. 6) may be any of several known types e.g. a carbon heater rod, resistive spiral, etc. The specific design and combination of elements of the apparatus will vary from application to application. Examples of suitable apparatus designs are given, for example, in F. Honn, A. N. Broers, et al., *J. Appl. Phys.* 53(3), March 1982, pp. 1283–1296.

The invention may be further understood in view of the following non-limiting examples.

EXAMPLES

Example 1 comparison of electron beam angular intensity as a function of total emission current for conventional vs. K-LaB6 cathodes.

Figure 7:
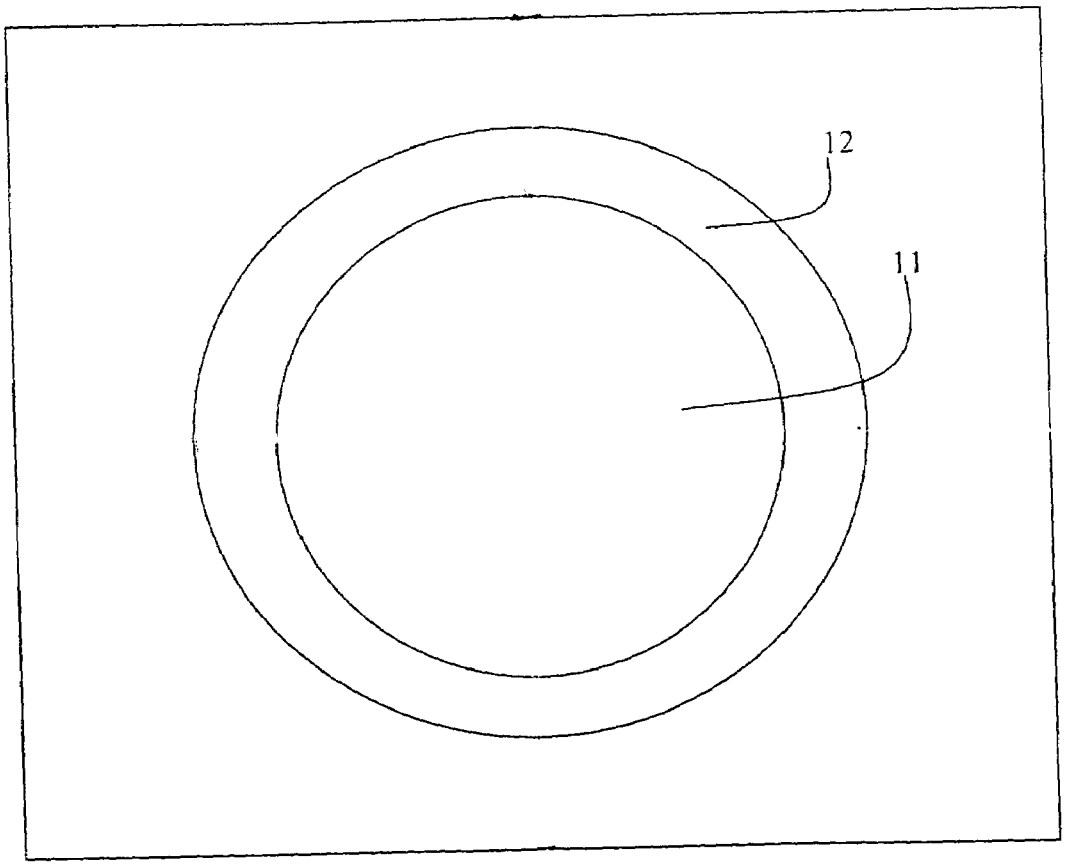
FIG. 7. Close-up top view depiction of tip of LaB6 crystalline emitter.

K-LaB6 cathodes with a coating of carbon applied to the cone surface of the cathode were prepared as follows: regular LaB6 emitters were placed into a chamber filled with carbon-rich gas (propane or butane) and heated up to a specified temperature for several minutes. After that, the emitters were removed from the chamber and the pyrolytic carbon coating formed on the surface was examined. Emitter tips were re-polished to remove carbon from the tips, thus exposing them (see FIG. 7). It was found, for this particular technique, that continuous, pinhole-free carbon coatings were formed with thicknesses ranging from 8 to 10 μm. K-cathodes with angles of 60 degrees and 90 degrees having tips with 50 and 100 μm diameters were fabricated in this manner.

Figure 8:
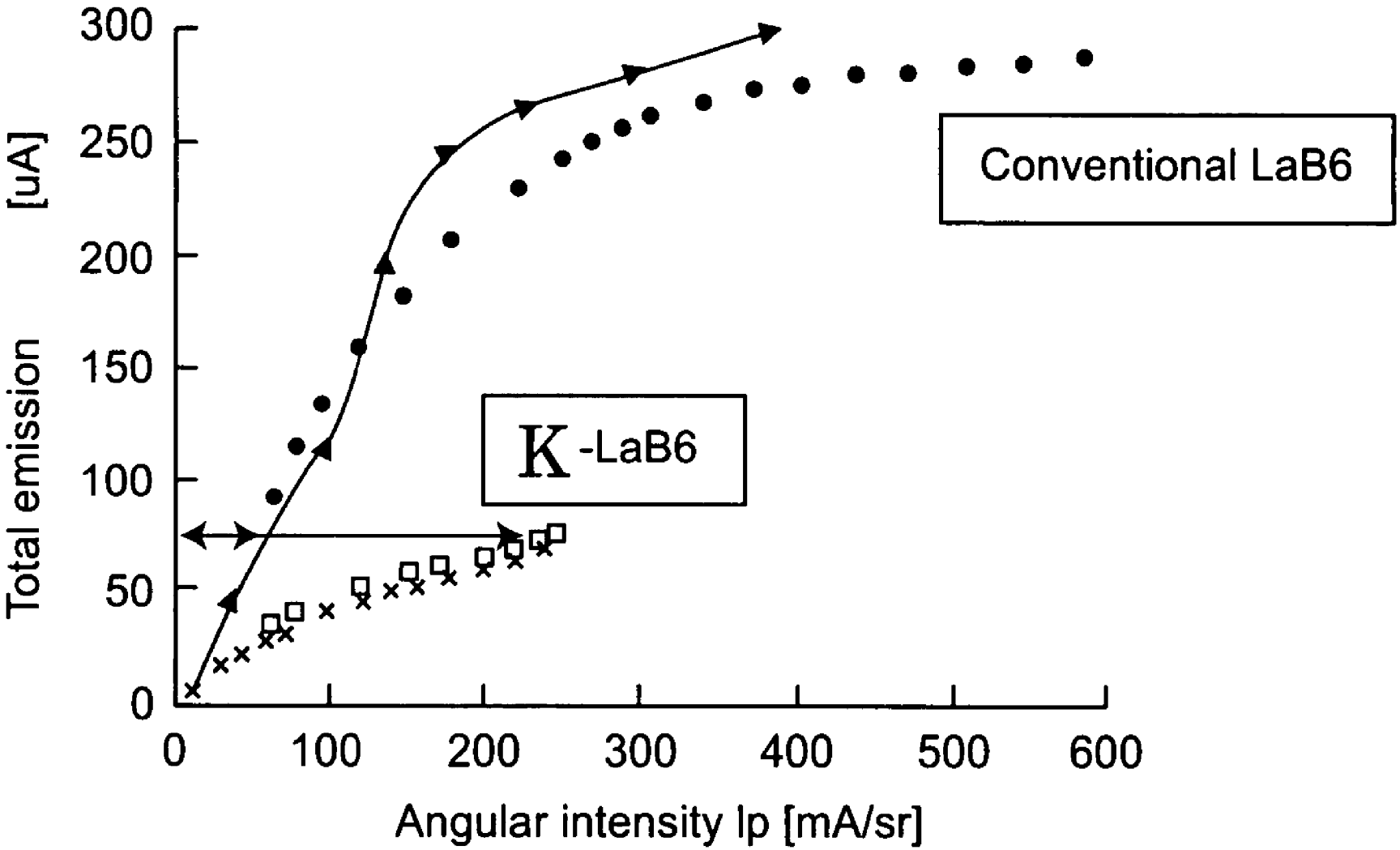
FIG. 8. Chart comparing electron beam angular intensity of conventional LaB6 cathodes and K-LaB6 cathodes.

A comparative study was undertaken in which total electron beam angular intensity as a function of total emission current for K-LaB6 cathodes was compared to comparable conventional LaB6 cathodes. Two K-LaB6 cathodes with 90 degree cone angles and 50 μm tips, and 2 regular LaB6 cathodes (also with 90 degree cone angles and 50 μm tips) were used. The results are presented in FIG. 8, where the x axis represents angular intensity and the y axis represents total emission current. In FIG. 8, two data sets obtained with conventional cathodes are shown as lines with triangles and circles, and two data set obtained with K-LaB6 cathodes are shown as lines with squares and x's. As can be seen, at the same total emission current (e.g. at 75 μA, indicated by the arrow) the K-LaB6 cathode provides about 4 times the beam angular intensity of the convention cathodes. Conversely, the K-LaB6 cathode provides the same beam angular intensity at a beam current that is about 4 times lower than that required when a conventional LaB6 cathode is employed.

This example demonstrates the electron-optical advantage of the K-LaB6 cathode: the K-LaB6 cathode provides an increase in angular intensity and brightness by a factor of 4 compared to conventional LaB6, at the same emission current.

Example 2

Optimization of Cone Angle in K-LaB6 Cathodes

Further studies were undertaken in order to investigate the effect of varying the cone angle of K-Lab6 cathodes on the lifetime of the cathode. K-LaB6 cathodes having cone angles of 90 and 60 degrees, and tip diameters of 50 μm were utilized. The cone surfaces of the cathodes had a carbon coating of 8 μm which had been deposited in a gas-filled chamber as described above in Example 1.

The two cathodes were then compared with respect to performance (e.g. percentage emission current and percentage of brightness remaining) before and after extended operation. The results are given in Tables 1 and 2, which show the results obtained with the 90 and 60 degree cone angles, respectively. The columns labeled "Material Loss" show the thickness in μm of LaB6 evaporated from the tip. The columns labeled "% Emission Current" show the percentage of emission current retained. The columns labeled "% Brightness" show percentage of brightness retained. The columns labeled "Hours of Operation" show operation at vacuum better than 1×E-7 Torr.

TABLE 1

Results obtained with 90° cone angle

| Material Loss (μm) | Cathode Temperature (° K) | % Emission Current | % Brightness | Hours of Operation |
|---|---|---|---|---|
| 0 | 1740 | 100 | 100 | 0 |
| 13 | 1740 | 99 | 96.5 | 1500 |
| 20 | 1740 | 52.9 | 75.5 | 2000 |

TABLE 2

Results obtained with 60° cone angle

| Material Loss (μm) | Cathode Temperature (° K) | % Emission Current | % Brightness | Hours of Operation |
|---|---|---|---|---|
| 0 | 1740 | 100 | 100 | 0 |
| 20 | 1740 | 62.1 | 99 | 2000 |
| 30 | 1740 | 52.6 | 77 | 3000 |

Figure 9:
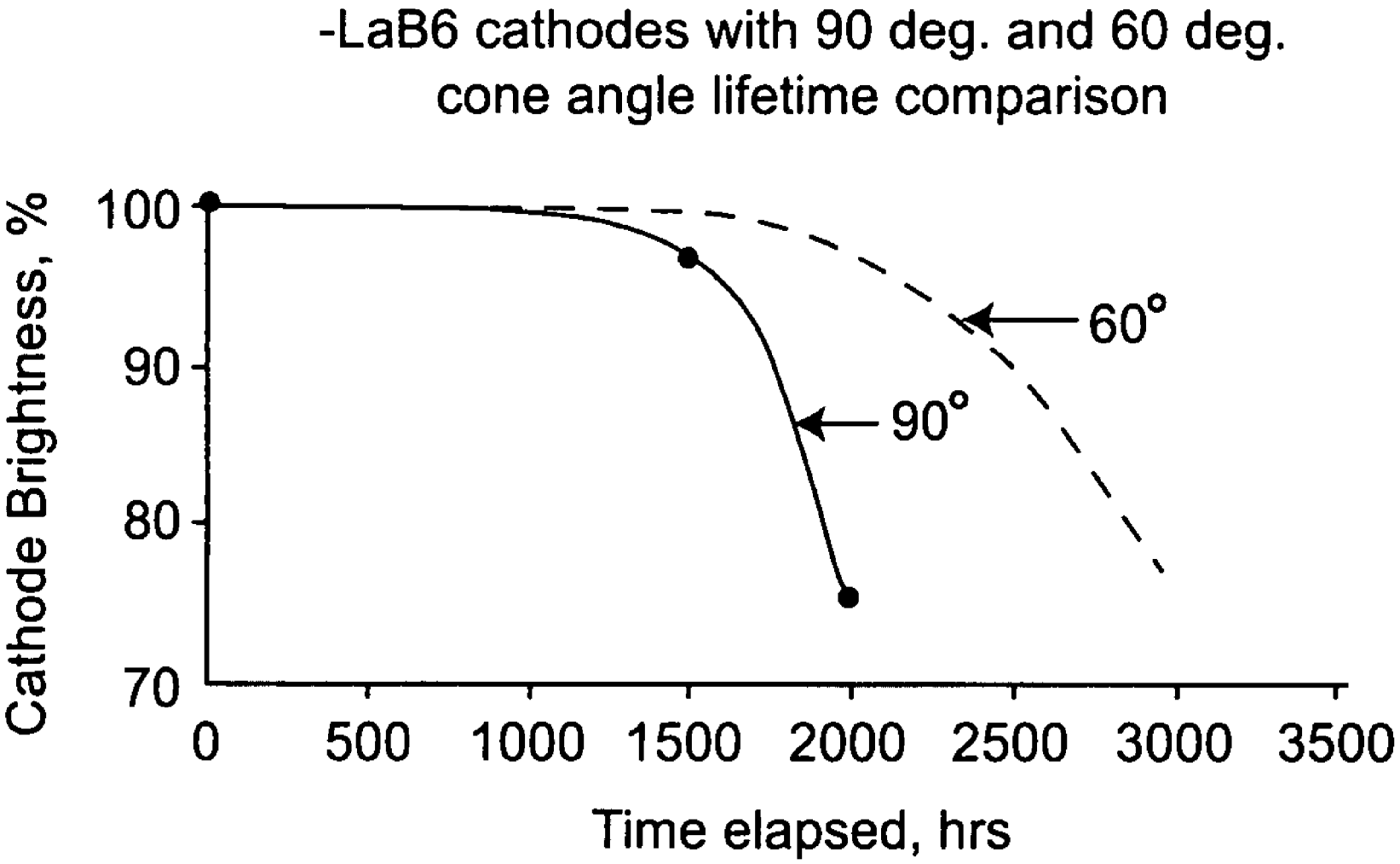
FIG. 9. Chart comparing cone angle lifetime of K-LaB6 cathodes with 90 and 60 degree cone angles.

The results are also represented graphically in FIG. 9. As can be seen, in the K-LaB6 cathode with a 90° cone angle, the brightness is reduced by 24.5% after 200 hours of operation, when the tip material loss has reached 20 μm. In most applications, such a reduction in brightness would signify the end of the cathode's useful lifetime. In contrast, in the K-LaB6 cathode with a 60° cone angle, the brightness is reduced by only 1% after 2000 hours of operation, when the tip material loss has also reached 20 μm. After 3000 hours of operation, a brightness level of 77% is still exhibited. Because a very high level of brightness is retained, the useful life of the cathode is significantly extended, for example, for at least 1000 hours compared to the non-carbon coated cathode.

This example demonstrates that, contrary to results obtained with conventional cathodes, K-LaB6 cathodes exhibit significantly longer useful lifetimes as the cone angle of the cathode is decreased.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the appended claims.

I claim:

1. A thermionic cathode comprising a crystalline emitter having a tip and a cone and sides, wherein said cone is positioned between said tip and said sides; and a carbon coating applied to an outer surface of said cone, wherein said sides of said crystalline emitter are not carbon coated.

2. A thermionic cathode as in claim 1, wherein said crystalline emitter is single crystal Lanthanum Hexaboride (LaB6).

3. A thermionic cathode as in claim 1, wherein said cone has a cone angle in the range of 20to 60 degrees.

4. A thermionic cathode as in claim 1, wherein said carbon coating is selected from the group consisting of pyrolytic carbon and diamond-like carbon (DLC).

5. A thermionic cathode as in claim 1, wherein said cone has a surface micro-roughness and wherein said carbon coating has a thickness of a least twice said micro-roughness.

6. A thermionic cathode as in claim 5, wherein said thickness is from 2 to 20 μm.

7. An improvement in a thermionic cathode having a crystalline emitter with a tip and a cone and sides, wherein said cone is positioned between said tip and said sides, the improvement comprising:

a carbon coating applied to an outer surface of said cone, wherein said sides of said crystalline emitter are not carbon coated.

8. The improvement of claim 7, wherein said crystalline emitter is single crystal Lanthanum Hexaboride (LaB6).

9. The improvement of claim 7, wherein said cone has a cone angle in the range of 20 to 60 degrees.

10. The improvement of claim 7, wherein said carbon coating is selected from the group consisting of pyrolytic carbon and diamond-like carbon (DLC).

11. The improvement of claim 7, wherein said cone has a surface micro-roughness and wherein said carbon coating has a thickness of at least twice said micro-roughness.

12. The improvement of claim 11, wherein said thickness is from 2 to 20 μm.

13. An electron emission apparatus, comprising a thermionic cathode comprising a crystalline emitter having a tip and a cone and sides, wherein said cone is positioned between said tip and said sides; and a carbon coating applied to an outer surface of said cone, wherein said sides of said crystalline emitter are not carbon coated;

an emitter heater; and a support for said crystalline emitter.

14. An electron emission apparatus as in claim 13, wherein said crystalline emitter is single crystal Lanthanum Hexaboride (LaB6).

15. An electron emission apparatus as in claim 13, wherein said cone has a cone angle in the range of 20 to 60 degrees.

16. An electron emission apparatus as in claim 13, wherein said carbon coating is selected from the group consisting of pyrolytic carbon and diamond-like carbon (DLC).

17. An electron emission apparatus as in claim 13, wherein said cone has a surface micro-roughness and wherein said carbon coating has a thickness of at least twice said micro-roughness.

18. An electron emission apparatus as in claim 17, wherein said thickness is from 2 to 20 μm.

19. A method of manufacturing a crystalline emitter for use in a thermionic cathode, comprising the step of applying a carbon coating to an outer surface of a cone of said crystalline emitter, wherein said carbon coating is not applied to sides of said crystalline emitter which are located below said cone.

20. The method of claim 19, wherein said carbon coating contains no pinholes.

21. The method of claim 19, wherein said crystalline emitter is single crystal Lanthanum Hexaboride (LaB6).

22. The method of claim 19, wherein said cone has a cone angle in the range of 20 to 60 degrees.

23. The method of claim 19, wherein said carbon coating is selected from the group consisting of pyrolytic carbon and diamond-like carbon (DLC).

24. The method of claim 19, wherein said cone has a surface micro-roughness and wherein said carbon coating has a thickness of at least twice said micro-roughness.

25. The method of claim 24, wherein said thickness is from 2 to 20 μm.

* * * * *